United States Patent [19]

Gupta et al.

[11] Patent Number: 4,549,981

[45] Date of Patent: Oct. 29, 1985

[54] VOLTAGE LIMITING COMPOSITION AND METHOD OF FABRICATING THE SAME

[75] Inventors: Tapan K. Gupta, Monroeville; William G. Carlson, Murrysville, both of Pa.; Joseph C. Osterhout, Bloomington, Ind.; Gerald B. Boyette, Bloomington, Ind.; Andrew S. Sweetana, Jr., Bloomington, Ind.

[73] Assignee: Electric Power Research Institute, Inc., Palo Alto, Calif.

[21] Appl. No.: 419,160

[22] Filed: Sep. 17, 1982

Related U.S. Application Data

[63] Continuation of Ser. No. 115,448, Jan. 25, 1980, abandoned, which is a continuation of Ser. No. 896,349, Apr. 14, 1978, abandoned.

[51] Int. Cl.[4] ..... H01B 1/06

[52] U.S. Cl. ..... 252/518; 252/519; 338/21; 29/610 R; 419/38; 419/39; 264/61; 264/66

[58] Field of Search ..... 252/518, 519; 338/21; 29/610 R; 419/38, 39; 264/61, 63, 66

[56] References Cited

U.S. PATENT DOCUMENTS 3,764,566 10/1973 Matsuoka et al. ..... 252/518

3,962,144 6/1976 Matsuura et al. ..... 252/518

*Primary Examiner*—Josephine L. Barr

*Attorney, Agent, or Firm*—Flehr, Hohbach, Test, Albritton & Herbert

[57] ABSTRACT

A voltage limiting composition, actually a nonlinear resistor, especially suitable for use in a gapless surge arrester is disclosed herein. This composition includes a predetermined amount of zinc oxide as its primary ingredient and one or more specifically selected additives. All of these constituents are combined and sintered so that the composition displays a nonlinear exponent $\alpha$ at least equal to about 35 over the current range of 1 ma to 5000 amps and such that its energy absorption capability is at least equal to about 50 joules/cm$^3$.

8 Claims, 1 Drawing Figure

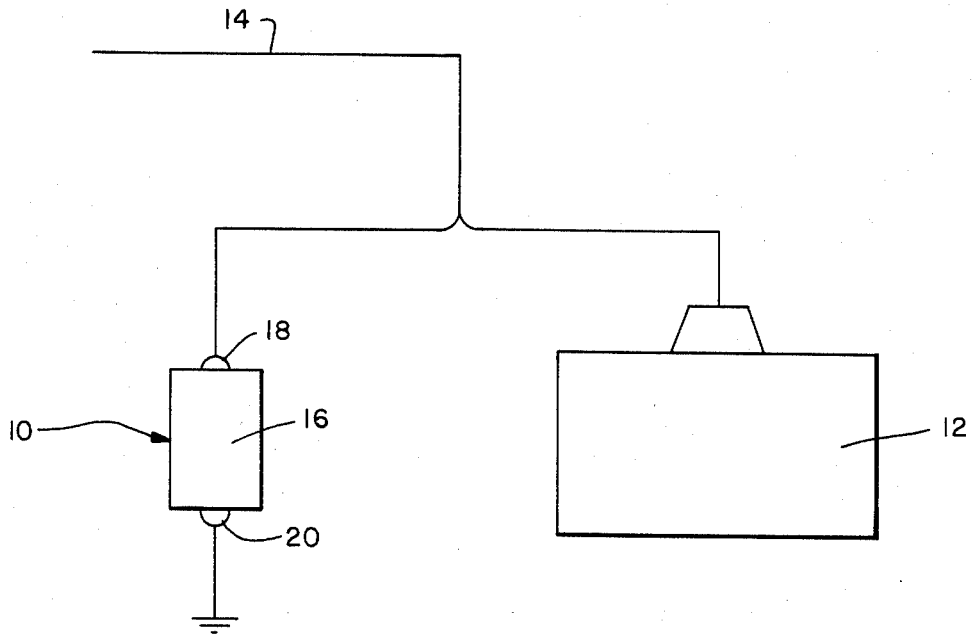
14
18
10
16
12
20

VOLTAGE LIMITING COMPOSITION AND METHOD OF FABRICATING THE SAME

This application is a continuation of U.S. application Ser. No. 115,448, filed Jan. 25, 1980 (abandoned) which in turn is a continuation of U.S. application Ser. No. 896,349 filed Apr. 14, 1978 (abandoned). Priority of these applications is hereby claimed.

BACKGROUND OF THE INVENTION

The present invention relates generally to voltage limiting compositions which are utilized as nonlinear resistors and particularly to a composition which displays specific operating characteristics and which is especially suitable for use in gapless surge arresters.

Nonlinear resistors, that is, resistors displaying nonlinear current-voltage characteristics, are used widely throughout the electronics industry in a number of different applications. As a result, these type of resistors differ substantially from one another in both physical attributes as well as operating characteristics, depending upon their ultimate intended use. However, all of these resistors in their nonlinear region of operation have a common nonlinear current-voltage characteristic which may be expressed by the empirical relation:

$$I=KV^{\alpha}$$

where V is voltage across the resistor, I is the current flowing through the resistor, K is a constant related to the geometry and to the microstructure of the resistor and $\alpha$ is a nonlinear exponent having a value greater than 1. The value of $\alpha$ is calculated by the following equation:

$$\alpha = \frac{\log 10\,(I_2/I_1)}{\log 10\,(V_2/V_1)}$$

where $V_1$ and $V_2$ are the voltages at given currents $I_1$ and $I_2$, respectively. The selection of these currents depends for the most part on the ultimate intended use of the resistor. For example, $\alpha$ may be determined over a current range of 0.1 ma ($I_1$) to 1 ma ($I_2$) or, in accordance with the present invention, as will be seen hereinafter, it is calculated over a much wider range, specifically over a range of 1 ma to 5000 amps.

To date, there has been a large number of studies on the relationship between the particular components making up a nonlinear exponent $\alpha$. For example, in U.S. Pat. No. 3,760,318, it can be seen that $\alpha$, actually "n" in the patent, varies widely, depending upon the particular composition of the resistor. This is equally true in U.S. Pat. No. 3,764,566. Moreover, it can be seen that the constant K, actually "C" in the patent where K equals $1/C^n$ is also varied. In both cases, one object is to provide a high $\alpha$ or n value at a readily controlled, preferably high K (low C) value. In the case of the '318 this is accomplished by diffusing lithium ions or sodium ions into a zinc oxide sintered body. In the case of the '566 patent, a resistor consisting of zinc oxide as its major constituent along with a number of other specific additives, for example silicon dioxide, bismuth oxide, cobalt oxide, manganese oxide and nickel oxide among others, is utilized to obtain a high $\alpha$ or n value and a high K or low C value, as well as a high degree of stability with respect to temperature, humidity, electric load and high resistance to surge current.

In addition to these patents, there are others which either seek to attain the same general objectives or which have other objectives in mind. For example, in U.S. Pat. No. 3,764,951, a nonlinear resistor having a stable voltage-current characteristic is the primary object and presumably this is accomplished by utilizing a sintered wafer consisting of iron oxide as the main component and calcium oxide as one of the number of additives combined with the iron oxide. In U.S. Pat. No. 3,570,002, one object is to provide a high $\alpha$ or n value and a high K or low C value. In this patent, the sintered disc of zinc oxide is combined with two electrodes, one being a silver electrode in non-ohmic contact with one surface of the disc and the other being the ohmic contact with an opposite surface. In U.S. Pat. No. 3,642,664, one of its objects is to provide a controllable $\alpha$ or K value, specifically a high value of $\alpha$. Another object is to provide a resistor having what is referred to as negative resistance. In this particular patent, a composition utilizing zinc oxide as its major constituent is disclosed in combination with an additive selected from a particular group including manganese fluoride, magnesium fluoride, calcium fluoride, etc.

It should be apparent from the foregoing that a great number of different characteristics of a nonlinear resistor can be manipulated depending upon the particular combination of constituents making up the resistor. Certainly one such characteristic is the nonlinear exponent $\alpha$. The resistor having a low $\alpha$, an intermediate $\alpha$ or a high $\alpha$ can readily be provided by those with ordinary skill in the art. In this regard it should be noted that a high $\alpha$ over a relatively small range, for example, 0.1 ma to 1 ma or a larger but relatively narrow range, for example 100a–1000a as in U.S. Pat. No. 3,838,378, can be attained. However, none of the patents cited disclosed a nonlinear resistor having a high $\alpha$ value over the current range of the present invention, specificallly from 1 ma to 5000 amps. This is an important feature, particularly where the nonlinear resistor is used in a gapless surge arrester. Moreover, it should be quite apparent that merely because a resistor has a high $\alpha$ over a low and/or narrow current range does not mean that the same $\alpha$ will be realized over the higher range of the present invention. In fact, $\alpha$ over a wide range will generally be less than over a narrow range.

What is seriously lacking in the prior art is a nonlinear resistor having both a high $\alpha$, particularly in the current range of the present invention, and a high surge energy absorption capability. Applicants have found that this particular combination of characteristics is quite important when the resistor is intended for use in high voltage surge arresters of the gapless type. As will be seen hereinafter, the present invention provides a composition having this unique combination.

OBJECTS AND SUMMARY OF THE INVENTION

One object of the present invention is to provide an uncomplicated and economical voltage limiting composition especially suitable for use in high voltage surge arresters in general and in gapless arresters in particular.

Another object of the present invention is to provide a voltage limiting composition of the type just recited, but one which is constructed in a particular way to display a high nonlinear exponent $\alpha$ over a wide current range and a high energy absorption capability.

Still another object of the present invention is to provide a particular composition sintered a particular way such that the composition displays a nonlinear exponent $\alpha$ at least equal to about 35 over the current range of about 1 ma to 5000 amps while, at the same time, it has an energy absorption capability at least equal to about 50 joules/cm$^3$.

A further object of the present invention is to provide a method of making a voltage limiting composition, specifically a nonlinear resistor of the type described.

As will be discussed in more detail hereinafter, a sintered voltage limiting composition especially suitable for use in a gapless surge arrester is disclosed herein. This composition includes zinc oxide (ZnO) as its primary constituent and a plurality of additives, all of which together form after sintering a microstructure comprising an array of zinc oxide grains which are separated from one another by an intergranular phase made up of the additives. In accordance with the present invention, this composition is constructed to display a nonlinear exponent $\alpha$ at least equal to about 35 over the current range of 1 ma to 5000 amps while, at the same time, displaying an energy absorption capability at least equal to about 50 joules/cm$^3$. In providing such a composition, the selection of the particular amount of zinc oxide and the particular kind and amounts of additives to be combined with the zinc oxide are of course important. However, just as important is the particular way in which this combination of components is sintered, as will be seen hereinafter.

BRIEF DESCRIPTION OF THE DRAWINGS

The single FIGURE shown is a schematic illustration of a gapless surge arrester which is constructed in accordance with the present invention and which is shown protecting a power transformer or other such equipment.

DETAILED DESCRIPTION AND PREFERRED EMBODIMENTS

Turning to the drawing, a surge arrester constructed in accordance with the present invention is illustrated and generally designated by the reference numeral 10. This arrester functions in a conventional way to protect the power transformer 12 or other such equipment against extraordinarily high surges in current resulting for example from an extraordinarily high buildup in energy within associated transmission line 14 or as a result of lightning striking the line. In either case, so long as the voltage appearing at transformer 12 is below a predetermined level, for example 1000 volts, the lightning arrester acts as an open circuit so that all the current passes into the transformer. However, should a higher voltage appear, even instantaneously at the transformer, the lightning arrester acts as a short circuit to shunt the corresponding surge in current. For a number of well known reasons, this arrester is preferably of the gapless type. However, in order to have a truly reliable and effective gapless arrester, applicants have found that the particular composition making up this type of voltage limiting device or actually nonlinear resistor should display a relatively high nonlinear exponent $\alpha$ over the wide current range set forth and it should also display a relatively high energy absorption capability to be described hereinafter.

As illustrated in the FIGURE, the surge arrester 10 includes a conventionally sintered body 16 as its active component, that is, as the voltage limiter or nonlinear resistor referred to above, and a pair of electrodes 18 and 20 applied to opposite surfaces thereof. These electrodes may be conventionally provided and conventionally connected to transmission line 14 and ground respectively. However, the composition of body 16 is not conventional but rather constructed in accordance with the present invention to display a nonlinear exponent $\alpha$ at least equal to about 35 over the current range of 1 ma to 5000 amps and, at the same time, display an energy absorption capability $J_0$ at least equal to about 50 joules/cm$^3$.

While $\alpha$ has been described previously, the energy absorption capability $J_0$ has not been described. $J_0$ was found by first subjecting the composition to a square wave current of 100 to 200 A for a 2500 microsecond duration. From the product of current magnitude, voltage magnitude (across the composition) and time, energy absorption was calculated. This was repeated 20 times at an interval of one minute to get an average $J_0$.

In order to provide the desired $\alpha$ and $J_0$ as recited above, body 16 incudes zinc oxide (ZnO) as its major constituent. It also includes a number of additives which together with the zinc oxide form a microstructure including an array of zinc oxide grains which are separated from one another by an intergranular phase made up of these additives. In a preferred embodiment, these additives include bismuth oxide ($Bi_2O_3$), cobalt oxide ($Co_3O_4$), manganese oxide ($MnO_2$), antimony oxide ($Sb_2O_3$) and silicon oxide ($SiO_2$). In an actual working embodiment, the composition of body 16 consists essentially of the following ingredients by mole %:

ZnO—93.5
$Bi_2O_3$—3.0
$Co_3O_4$—1.0
$MnO_2$—1.0
$Sb_2O_3$—1.0
$SiO_2$—0.5.

Of particular interest is the cobalt oxide. It has been found that this particular additive enhances the stability of body 16. More specifically, it has been found that when a nonlinear resistor includes this cobalt oxide, the latter acts as a "use stabilizer." More specifically, the voltage characteristics of a number of samples were evaluated at a given current, specifically 10 ma. This was done before the samples were subjected to current surges ($8\times20$ microsecond surges) and after being subjected to such surges so as to obtain a voltage change. These samples, with the exception of one, included varying amounts of $Co_3O_4$. It was shown that the samples including $Co_3O_4$ displayed a lower change in voltage than the samples without $Co_3O_4$ and hence reduced deterioration. In a preferred embodiment, 1 to 3 mole % of $Co_3O_4$ is used. In this regard it is understood that the other additives just listed may also vary within a range. For example, each of these other additives may vary as much as $\pm75\%$.

With the exceptions to follow, the body 16 is prepared in accordance with well known ceramic techniques. For example, the zinc oxide and additives, as described above, are mixed in a wet mill so as to produce a homogeneous mixture which, in turn, is dried and pressed at pressures between 35 MPA and 138 MPA into the desired shape. The resultant homogeneous body is thereafter sintered in accordance with the present invention, as will be described below, and then cooled to room temperature (about 25° C.). If desired, the mixture can be preliminarily calcined and pulverized for easy fabrication in the subsequent pressing steps and it can be admixed with a suitable binder such as water, polyvinyl alcohol, or the like. Moreover, other conventional techniques were appropriate can be readily provided.

As stated, with the exception of the manner in which body 16 is sintered, the process just described is or may be conventional. In this regard, Applicants have found there to be a unique relationship between the sintering process, the particular constituents making up the composition, the microstructure of the composition once sintered, and the nonlinear exponent $\alpha$ and energy absorption capability $J_0$ obtainable by the sintered composition. More specifically, Applicants have found that both $\alpha$ and $J_0$ are intimately related to the microstructure of the sintered zinc oxide composition which can be viewed simply as an array of semiconducting zinc oxide grains that are separated from one another by an intergranular phase comprised of the various additives. The zinc oxide grains are significant in that $\alpha$ tends to increase with decreasing grain size whereas $J_0$ tends to increase with increasing grain size. Moreover, it has been found that the grain size increases with increases in temperature and time of sintering and decreases with decreases in sintering temperature and time.

From the foregoing relationships, it should be apparent that $\alpha$ and $J_0$, that is, the nonlinear exponent and energy absorption capability of the given composition including zinc oxide and the associated additives, specifically those additives recited above, are together dependent upon the particular time during which and the particular temperature at which the composition is sintered. Based on this information, the unique combination of composition constituents and sintering temperature/time which will produce a grain size resulting in both a high value of $\alpha$ and a high value of $J_0$ can be realized. One such combination utilizes the particular composition referred to above. That composition was sintered at a temperature of approximately 1300° C. for approximately 1.5 hours and, as will be seen below, displayed a zinc oxide grain size (conventionally estimated) of about 19 micrometers and $\alpha$ over the current range of 1 ma to 5000 amps of about 36 and a $J_0$ of about 52 joules/cm$^3$.

While the particular embodiment described is indeed a preferred embodiment and, in fact, an actual working embodiment of the present invention, it is to be understood that the present invention is not limited to this particular embodiment. The composition of the present invention is one which utilizes zinc oxide as its primary constituent and which also utilizes some if not all of the various additives recited above in varying amounts. This composition is formed into the desired shape and is thereafter sintered for a predetermined period of time at a predetermined temperature such that the composition displays a microstructure including an array of zinc oxide grains which are separating from one another by an intergranular phase made up of the other constituents, that is, the additives. In accordance with the present invention, the particular amount of zinc oxide, the particular kinds and amounts of additives and the particular sintering time and temperature are all selected such that the voltage limiting composition displays a nonlinear exponent $\alpha$ at least equal to about 35 over the current range of 1 ma to 5000 amps and such that its energy absorption capability $J_0$ is at least equal to about 50 joules/cm$^3$.

While the most preferred embodiment is that particular embodiment described above in accordance with the teachings of the present invention, it may be possible to vary the amounts of zinc oxide utilized as well as the amounts of the particular additives selected and also the sintering time and temperature to reach the same end, that is an $\alpha$ at least equal to 35 at the recited current range and a $J_0$ at least equal to 50. In this regard, the temperature range of about 1100° C., preferably 1250° C. to 1300° C. and the time range of between about 1 hour to 20 hours, preferably between 2 hours and 10 hours are preferred. Moreover, the microstructural grain size for the zinc oxide in the range of 15 to 30 micrometers is also preferred.

Having described the voltage limiting behavior of body 16 generally and also a preferred and actual working embodiment, attention is directed to a number of examples which will illustrate the complexity of the problem which confronted Applicants of the present invention. These examples will also illustrate the unique correlation between the particular composition to be selected and the particular manner in which it is sintered. Consider specifically the three compositions which are shown in Table I below.

TABLE I

| Composition Code | Composition of ZnO Ceramics | | | | | | | Mole % Ttl. Additives |
|---|---|---|---|---|---|---|---|---|
| | ZnO | $Bi_2O_3$ | NiO | $Co_3O_4$ | $MnO_2$ | $Sb_2O_3$ | $SiO_2$ | |
| (1) | 92.0 | 4.5 | 0 | 1.0 | 1.0 | 1.0 | 0.5 | 8.0 |
| (2) | 93.5 | 3.0 | 0 | 1.0 | 1.0 | 1.0 | 0.5 | 6.5 |
| (3) | 90.5 | 4.5 | 1.5 | 1.0 | 1.0 | 1.0 | 0.5 | 9.5 |

It should be apparent that the main differences between these compositions are the variations in bismuth oxide ($B_2O_3$) and nickel oxide (NiO). Each of these compositions were spray dried in a conventional manner and pressed into discs ranging in densities from about 2.5 g/cm$^3$ to 3.5 g/cm$^3$ and were approximately 5 cm in diameter and 1 cm in height. This was accomplished in a conventional manner, for example as described above. These discs were sintered under various time/temperature conditions as recited in Table II below and were electrically tested to evaluate $\alpha$, $J_0$ and the voltage at 1 ma ($E_1$).

TABLE II

Electrical Properties of ZnO Ceramics for Several Combinations of Composition-Temperature-Time and Microstructure

| Composition Code | Temperature (°C.) | Time (hr) | Estimated Grain size | $\alpha$ | | $J_0$ (Joules/cm$^3$) | $E_1$ma (V/cm) |
|---|---|---|---|---|---|---|---|
| | | | | $\alpha_1$ 1 ma–5000a | $\alpha_2$ 500a–5000a | | |
| (3) | 1125 | 2.5 | 9.0 | 51 | 15 | 11 | 2700 |

TABLE II-continued

| Electrical Properties of ZnO Ceramics for Several Combinations of Composition-Temperature-Time and Microstructure | | | | | | | |
|---|---|---|---|---|---|---|---|
| | | | Estimated | α | | | |
| Composition Code | Temperature (°C.) | Time (hr) | Grain size | $\alpha_1$ 1 ma-5000a | $\alpha_2$ 500a-5000a | $J_0$ (Joules/cm$^3$) | $E_1$ma (V/cm) |
| | 1330 | 2.7 | 26.0 | 36 | 12 | 33 | 856 |
| (2) | 1050 | 1.0 | 6.0 | 44 | 18 | 16 | 3624 |
| | 1300 | 1.5 | 19.0 | 36 | 12 | 52 | 1225 |
| | 1300 | 5.0 | 30.0 | 38 | 19 | 48 | 778 |
| (1) | 1050 | 1.0 | 6.0 | 37 | 16 | 0 | 3743 |
| | 1150 | 2.4 | 10.0 | 39 | 18 | 21 | 2374 |

As noted above, Table II gives the particular composition, the temperature and time of sintering, the estimated grain size, the value of $\alpha$, $J_0$ and $E_1$. Moreover, the value of $\alpha$ is not only given over the current range of 1 ma to 5000 amps ($\alpha_1$) but also between 500 amps and 5000 amps ($\alpha_2$). This latter quantity while not particularly relevant to the present invention is illustrated to show the degree of nonlinearity at high current density. With respect to the current range, it is important to note that this range is for samples about 5 cm in diameter by 1 cm high. This means that for each cm$^2$, the range is about 0.05 ma–255 a ($\alpha_1$) and about 25.5 a–255 a ($\alpha_2$).

With the No. 3 composition, which had 4.5% bismuth oxide and 1.5% nickel oxide, it is seen that by increasing the temperature from 1125° C. to 1330° C. and the time from 2.5 hours to 2.7 hours, the values of $\alpha$ and $E_1$ are decreased and $J_0$ is increased. At the same time, the grain size was found to increase substantially. These observations were found to be generally true for many combinations of composition-temperature-time and grain size. Thus, for any given composition optimum sintering conditions exist that uniquely determine the electrical properties of the sintered device. Thus if the primary requirement for a given application is a high value of $\alpha$ ($\alpha_1$) (greater than 50) over a wide range of current, the sintering of composition No. 3 can be performed at 1125° C. for 2.5 hours. It should be noted that under these conditions $J_0$ is limited to about 11 joules/cm$^3$. If the requirement calls for a higher value of $J_0$ the above sintering conditions are clearly unsuitable. It would then require a different set of sintering conditions as seen in Table II. At 1330° C. and 2.7 hours, $\alpha_1(\alpha)$ is reduced from 51 to 36. Thus the specific electrical requirements of a given application determines the combination of composition-temperature-time and grain size required.

Examination of the data for devices prepared from composition No. 2, that is, the preferred composition of the present invention, gives similar results. When the temperature is increased from 1050° C. to 1330° C. and time from 1.0 to 1.5 hours, the grain size and $J_0$ increase and $\alpha$ value and $E_1$ decrease. Note, however, that for almost identical values of $\alpha$, $J_0$ is substantially increased in this composition-temperature-time and grain size combination as compared to the $J_0$ observed in composition No. 3. Thus, composition No. 2 sintered at 1300° C. for 1.5 hours is recommended for applications requiring a combination of high $\alpha$ and $J_0$ values, that is, applications of the present invention. If the sintering time is now increased from 1.5 hours to 5 hours, there is more than 50% improvement in high current $\alpha_2$ which gives even better protection at high surge currents. In doing so, however, the $J_0$ value is slightly reduced from 52 to 48 joules/cm$^3$ (which is certainly about 50) with a corresponding reduction in $E_1$ and an increase in grain size. Thus by increasing the sintering time, the high current nonlinearity is significantly improved, again at the expense of $J_0$, although this latter change is not so drastic. Note, however, that an increase in grain size from 19 to 30 micrometers and a decrease in $E_1$ from 1225 to 778 V/cm do not necessarily assure an improvement in $J_0$ as observed previously. The right choice of temperature and time for a given composition is thus very critical.

A somewhat different situation exists when the sintering temperature is kept low, between 1000° C. and 1150° C., as illustrated for composition No. 1. By raising the sintering temperature and time, $J_0$, $E_1$ and the grain size are increased and $E_1$ is decreased as before, but the value of $\alpha$ is also slightly increased. Although these data show the deviation from the previous observations with regard to the effect of temperature and time on $\alpha$, it revals another complexity in the behavior of the materials. Specifically, at 1050° C. and 1 hour, the chemcial reaction between six different component oxides are not complete. Under these conditions, the device is chemically inhomogeneous as was evidenced in the microstructure, and the condition represented an unstable equilibrium between the different phases. This is illustrated by the complete lack of energy absorption ($J_0=0$) by the composition. In such cases the higher temperature must be used to fabricate it.

The examples discussed above clearly indicate the complexity of the material interactions and serve to illustrate the unique correlation that exists between composition-temperature-time-microstructure and the electrical properties such as $\alpha$, $J_0$ and $E_1$. The disclosure regarding a particular composition must be accompanied by disclosure regarding temperature-time and grain size for a given application. Upon careful studies of various examples similar to those cited in Table II, the composition No. 2 with a sintering condition of 1300° C. for 5 hours was utilized to construct a 6 kV gapless lightning arrester. This arrester was built and tested as a prorated section of a 120 kV intermediate class arrester on a 138 kV system. The arrester was housed in a porcelain enclosure and tested as per ANSI C62.1 surge arrester standards, where applicable. The discharge voltage characteristic at 1.5, 3, 5, 10 and 20 kA surges (8×20 microseconds wave) were carried out and are shown in Table III and compared to a conventional silicon carbide IVL arrester manufactured by the Westinghouse Electric Corporation.

TABLE III

| Discharge Voltage Test of 6 kV ZnO Arrester | | |
|---|---|---|
| | Voltage (kV) | |
| Current* (kA) | ZnO Arrester | IVL Arrester Made from SIC |
| 1.5 | 12.44 | 10.4 |
| 3.0 | 13.11 | 11.9 |
| 5.0 | 13.42 | 13.2 |
| 10.0 | 14.36 | 15.0 |
| 20.0 | 16.11 | 17.4 |

*8 × 20 μs surges.

In this sequence, the zinc oxide arrester was sized to match conventional arrester protective characteristics at 10 kA. Note that the different slopes involved, for lower matching currents, zinc oxide has a higher discharge voltage than the SIC arrester which was also tested at the surge currents referred to above, as indicated in Table III. However, for higher currents (where insulation stresses are severe) the zinc oxide discharge voltage is lower. Thus, the zinc oxide arrester has a superior protective characteristic at high current surges.

It is to be understood that the foregoing examples have been provided for examplary purposes only and are not intended to limit the present invention.

What is claimed is:

1. A method of fabricating a voltage limiter especially suitable for use in gapless lightning arresters, said method comprising:

(a) preparing a composition which is selected to consist essentially of the following ingredients by approximate mole %:

| | |
|---|---|
| ZnO | 93.5 |
| $Bi_2O_3$ | 3.0 |
| $Co_3O_4$ | 1.0 |
| $M_nO_2$ | 1.0 |
| $Sb_2O_3$ | 1.0 |
| $SiO_2$ | 0.5 |

(b) forming the composition into the desired shape;

(c) sintering the formed composition for a predetermined period of time at a predetermined temperature such that the composition displays a microstructure including an array of ZnO grains which are separated from one another by an intergranular phase made up of the remaining ingredients of said compositions; and (d) the particular amount of ZnO, the particular amount and kinds of additives and the particular sintering time and temperature being such that for a sample 5 cm in diameter by 1 cm high the voltage limiting composition displays an energy absorption capability at least equal to about 50 joules/cm$^3$ and a nonlinear exponent $\alpha$ at least equal to about 35 as determined by the following equation for $\alpha$:

$$\alpha = \frac{\log 10\,(I_2/I_1)}{\log 10\,(V_2/V_1)}$$

where $V_1$ and $V_2$ are the respective voltages across said sample at currents $I_1$ and $I_2$ flowing therethrough and where $I_1$ and $I_2$ are 1 ma and 5000 amps, respectively.

2. A voltage llimiting composition especially suitable for use in a gapless lightning arrester, said composition consisting of the following ingredients by approximate mole %:

| | |
|---|---|
| ZnO | 93.5 |
| $Bi_2O_3$ | 3.0 |
| $Co_3O_4$ | 1.0 |
| $M_nO_2$ | 1.0 |
| $Sb_2O_3$ | 1.0 |
| $SiO_2$ | 0.5 |

said composition displaying a microstructure including an array of ZnO grains which are separated from one another by an intergranular phase made up of the remaining ingredients of said composition and being sintered such that for a sample 5 cm in diameter by 1 cm high it displays an energy absorption capability at least equal to about 50 joules/cm$^3$ and a nonlinear exponent $\alpha$ at least equal to about 35 as determined by the following equation for $\alpha$:

$$\alpha = \frac{\log 10\,(I_2/I_1)}{\log 10\,(V_2/V_1)}$$

where $V_1$ and $V_2$ are the respective voltages across said sample at currents $I_1$ and $I_2$ flowing therethrough and where $I_1$ and $I_2$ are 1 ma and 500 amps, respectively.

3. A method according to claim 1 wherein said composition is sintered at a temperature between about 1100° C. and 1350° C. for a predetermined period of time between about two hours and ten hours.

4. A method according to claim 1 wherein said composition is sintered at a temperature of about 1300° C. for about 1.5 hours.

5. A method of fabricating a voltage limiter especially suitable for use in gapless lightning arresters, said method comprising:

(a) preparing a composition which is selected to consist essentially of the following ingredients by approximate mole %:

| | |
|---|---|
| ZnO | 93.5 |
| $Bi_2O_3$ | 3.0 |
| $Co_3O_4$ | 1.0 |
| $M_nO_2$ | 1.0 |
| $Sb_2O_3$ | 1.0 |
| $SiO_2$ | 0.5 |

(b) forming the composition into the desired shape; and (c) sintering the formed composition for about 1.50 hours at a temperature of about 1300° C. such that for a sample 5 cm in diameter by 1 cm high the voltage limiting composition displays an energy absorption capability at least equal to about 50 joules/cm$^3$ and a nonlinear exponent $\alpha$ at least equal to about 35 as determined by the following equation for $\alpha$:

$$\alpha = \frac{\log 10\,(I_2/I_1)}{\log 10\,(V_2/V_1)}$$

where $V_1$ and $V_2$ are the respective voltages across said sample at currents $I_1$ and $I_2$ flowing therethrough and where $I_1$ and $I_2$ are 1 ma and 5000 amps, respectively.

6. A voltage limiting composition especially suitable for use in a gapless lightning arrester, said commposition consisting essentially of the following ingredients by approximate mole %:

| | |
|---|---|
| ZnO | 93.5 |
| $Bi_2O_3$ | 3.0 |
| $Co_3O_4$ | 1.0 |
| $M_nO_2$ | 1.0 |
| $Sb_2O_3$ | 1.0 |
| $SiO_2$ | 0.5 |

said composition displaying an energy absorption capability at least equal to about 50 joules/cm$^3$ and a nonlinear exponent $\alpha$ at least equal to about 35 as determined by the following equation for $\alpha$:

$$\alpha = \frac{\log 10\,(I_2/I_1)}{\log 10\,(V_2/V_1)}$$

where $V_1$ and $V_2$ are the respective voltages across said sample at currents $I_1$ and $I_2$ flowing therethrough and where $I_1$ and $I_2$ are 1 ma and 5000 amps, respectively.

7. The method according to claim 1 wherein said composition is formed to have a density beteween about 2.5 g/cm$^3$ and 3.5 g/cm$^3$.

8. A composition to claim 2 having a density between about 2.5 g/cm$^3$ and 3.5 g/cm$^3$.

* * * * *